US010245753B2

(12) United States Patent
Hancock et al.

(10) Patent No.: US 10,245,753 B2
(45) Date of Patent: Apr. 2, 2019

(54) RETRACTABLE CHAINSAW GUARD

(71) Applicant: Safety Guard Products LLC, Huntington, WV (US)

(72) Inventors: Matthew Wesley Hancock, Scott Depot, WV (US); Ryan Timothy Daly, Scott Depot, WV (US); Noah Arthur Barker, Winfield, WV (US)

( * ) Notice: Subject to any disclaimer, the term of this patent is extended or adjusted under 35 U.S.C. 154(b) by 4 days.

(21) Appl. No.: 15/646,638

(22) Filed: Jul. 11, 2017

(65) Prior Publication Data

US 2019/0016007 A1 Jan. 17, 2019

(51) Int. Cl.
*B27G 19/00* (2006.01)
*B27B 17/02* (2006.01)

(52) U.S. Cl.
CPC ..... *B27G 19/003* (2013.01); *B27B 17/02* (2013.01)

(58) Field of Classification Search
CPC ..... B27G 19/003; B27B 17/02
USPC ..... 30/373, 382
See application file for complete search history.

(56) References Cited

U.S. PATENT DOCUMENTS 2,638,944 A 5/1953 Woleslagle
3,059,673 A 10/1962 Woleslagle
3,344,818 A * 10/1967 Musgrove ..... B23Q 13/00 30/151
3,384,136 A 5/1968 Marin et al.
4,060,894 A 12/1977 Hampton
4,063,358 A * 12/1977 Hodge ..... B27G 19/003 30/371
4,134,460 A 1/1979 Klemm
4,257,162 A 3/1981 Pardon
4,447,953 A 5/1984 Lombardino et al.
4,841,641 A 6/1989 Laidlaw
4,945,641 A 8/1990 Miller et al.
4,991,297 A 2/1991 Cain
5,179,785 A 1/1993 Nagashima
5,269,064 A 12/1993 Greene et al.
(Continued)

*Primary Examiner* — Hwei-Siu C Payer
(74) *Attorney, Agent, or Firm* — Dinsmore & Shohl LLP; Monika L'Orsa Jaensson, Esq.

(57) ABSTRACT

The disclosed technology generally regards a chainsaw guard mountable on a chainsaw having a motor powerhead housing, a drive motor contained in the housing, a saw chain guide bar mounted on the housing, and a saw cutter chain driven by the drive motor and carried on the saw chain guide bar, the chainsaw guard forming a physical barrier that limits access to the saw cutter chain when the chainsaw guard is mounted on the powerhead housing. The chainsaw guard includes a bracket member mountable to a chainsaw motor powerhead housing, and a retractable member movably engaged with the bracket member and designed and configured to sheathe the saw chain guide bar and saw cutter chain of the chainsaw when the chainsaw guard is mounted on a chainsaw. Engaged with the bracket member and the retractable member are compressible springs about one or more guide rods, the springs having a spring force to position the retractable member relative to the bracket member in the extended position until a force greater than the spring force is applied to the distal end of the retractable member, translating the retractable member towards the retracted position; when the force is removed from the distal end of the retractable member, the retractable member by the spring force moves to the extended position.

15 Claims, 11 Drawing Sheets

(56) References Cited

U.S. PATENT DOCUMENTS

| | | | | |
|---|---|---|---|---|
| 5,435,065 | A * | 7/1995 | Raczykowski | B27B 17/0083 30/382 |
| 5,535,521 | A | 7/1996 | Alcorn | |
| 5,850,696 | A | 12/1998 | Sciarrone | |
| 6,389,700 | B2 | 5/2002 | Paquin | |
| 8,752,301 | B2 | 6/2014 | George | |
| 9,789,627 | B2 * | 10/2017 | Engelfried | B27G 19/003 |
| 2019/0016007 | A1 * | 1/2019 | Hancock | B27G 19/003 |

* cited by examiner

RETRACTABLE CHAINSAW GUARD

BACKGROUND OF THE INVENTION

The disclosed technology regards a chainsaw guard mountable on a chainsaw, the chainsaw guard forming a physical barrier that limits access to the chainsaw's saw cutter chain when the chainsaw guard is mounted on the powerhead housing. The chainsaw guard of the disclosed technology positions a retractable member relative to a bracket member in an extended position, partially sheathing the chainsaw saw cutter chain until a force greater than the spring force is applied to the distal end of the retractable member, translating the retractable member towards a retracted position; when the force is removed from the distal end of the retractable member, the retractable member moves back to the extended position by means of the spring force.

Chainsaw usage by relatively unskilled personnel has increased in recent years and as a result the number of chainsaw accidents has increased. Gasoline, electric and battery powered chainsaws have become increasingly popular for suburban dwellers having relatively little experience in their use. Exposed saw cutting chains are dangerous whether running or idle, and inexperienced users cutting brush or trimming the tops of trees or small limbs sometimes come in contact with the upper part of the cutting chain. Also, while cutting, the cutting chain can become wedged or lodged in a tree trunk or limb, which stops the cutting chain movement and causes it to react by "kicking-back" violently.

Kickback of a chainsaw is when the teeth on the chain catch on material (e.g., wood or metal) as they rotate around the tip of the blade. The teeth may have enough force to cause the blade to kick back violently toward the chainsaw operator, hence the term "kickback." In some examples, kickback may occur when the nose of the blade of a chainsaw strikes another object such as a metal spike, when starting a bore cut improperly, and when the blade nose or tip of the chainsaw catches the bottom or side of a saw cut during reinsertion. Kickback is particularly dangerous because it is so violent and it occurs so rapidly that the chainsaw operator is challenged to avoid serious injury. The chainsaw reacts by kicking back violently in an upwardly rotating arc, and thus back toward the head, shoulders and chest of the operator, potentially causing serious injury.

Another potentially injurious problem with chainsaws involves cut-through, which occurs when the chainsaw blade passes through the wood and continues to swing downward towards the lower body of the operator. This loss of control may occur if the chainsaw operator is poorly trained or distracted. In one example, a chainsaw operator may saw through a log and be unprepared when the log is cut all the way through. Pressure on the chainsaw may cause the chainsaw to complete the cut and then torque towards an unprotected portion of the operator's body.

Dropping an active chainsaw may also lead to significant injury. These kinds of accidents may occur if the chainsaw is being used in a tree or by an inattentive operator who allows the chainsaw to slip from the operator's grip. Further, because of the sharp edges of cutter chains, chainsaws may even cause injuries to individuals carrying or handling the chainsaws, and their sharp edges may be damaged by unintended contact with objects.

In the prior art a number of devices are known which either surround or cover the guide bar on a chainsaw to prevent contact between the saw chain and the user in the event of chainsaw kickback or cut-through. In order for the saw to continue to have full utility, guards must allow the saw to pass through the material being cut, without interference. To this end, a variety of springs, levers and guard configurations have been proposed. While the devices may be useful, they do tend to limit the utility of the chainsaw because of the complexity of the mounting mechanism and of the guard devices, or they provide protection either for kickback or cut-through, but not for both.

Patents that disclose a guard for a chainsaw include U.S. Pat. Nos. 2,638,944; 4,143,460; 4,447,953; 4,841,641; 4,945,641; 4,991,297; and, 5,179,785.

One way previously proposed to minimize the risk of such injuries and damage was to place a chainsaw in a sealed portable case or similar container. However, the substantial weight and volume of such cases rendered them unattractive to individuals using them, especially loggers, who frequently have to carry chainsaws on foot to working sites. Exemplary cases are described in Schurman U.S. Pat. No. 4,369,575 granted Jan. 25, 1983, Reynolds U.S. Pat. No. 5,119,937 granted Jun. 9, 1992, and Griffin U.S. Design Pat. No. 359,849 granted Jul. 4, 1995.

Another way previously proposed to prevent such injuries was to provide a guard, sheath, or the like to limit access to the cutter chain. However, in many such proposed devices, the protection provided the individual was during sawing operation, not primarily protection during carrying or transporting the chainsaws. For example, many bar guards, sheaths, or the like were designed to prevent kickback when operating the chainsaw. Therefore, a portion of the cutter chain was always exposed when using such devices; the possibility of damage or injury during transportation was not prevented. An exemplary open guard is illustrated in Holzworth U.S. Pat. No. 4,193,193 granted Mar. 18, 1980. A similar such guard hingedly connected to the saw is described in Shivers U.S. Pat. No. 4,621,426 granted Nov. 11, 1986. The Shivers bar guard remains attached to the saw during the sawing operation while it is pivoted upwards away from the guard, interfering with the operator's view of the log or other workpiece.

Other such protective devices often required some modification of the chainsaw itself. By way of example, in Otoupalik U.S. Pat. No. 3,042,087 granted Jul. 3, 1962, a protective sheath was designed to be removably attached to the chainsaw by a pair of removable tension springs. The cutter chain was completely sealed when the sheath was attached. However, the primary objective of the described invention was to protect the cutter chain and guide bar from damage during transportation of the chainsaw. As a result, the combined chainsaw and guard remained hazardous to the person carrying the chainsaw with the sheath thereon. For example, since the tension springs were hooked onto the chainsaw handle bar, the springs often interfered with carrying the chainsaw. Further, when the sheath was attached, the tension springs were always in extension. Thus, it was quite possible that the person carrying the chainsaw with the sheath thereon might be injured by the tension spring if it were accidentally dislodged. Simply by using the Otoupalik device, the risk of at least some types of injury increased.

Woleslagle U.S. Pat. No. 2,683,944 granted May 19, 1953 discloses a telescoping sheath that provides blade protection during transport and a set of concentric telescoping spring loaded tubes to restore the telescoping sheath to its resting, protective position. The disclosed concentric telescoping spring loaded tubes must move freely and rapidly. To reduce friction, the cutting chain must be well lubricated, most desirably with a viscous oil that will cling to the chain. This feature is counter to that desired for the concentric telescoping spring-loaded tubes of Wolesage, that must move freely and rapidly. Specifically, so that the lubricant clings to the rapidly moving saw chain, a higher viscosity lubricant is desirable; for the concentric telescoping spring-loaded tubes a lubricant with low viscosity is appropriate. A design that functions with a single lubricant is needed.

Chainsaws are inherently dangerous implements for both experienced accidental and inexperienced operators. Even the briefest contact between the saw operator and a moving saw chain can cause serious and often permanent injury. Because of the potential for dangerous accidents, numerous devices have been developed and patented over the years to protect the chainsaw operator. Examples of prior art safety guards include devices which extend along one edge of the cutter bar and pivot out of the way, as shown in U.S. Pat. Nos. 3,384,136 and 4,060,894; pivoting covers that fully or partially sheath the cutter bar and pivot out of the way during use, as shown in U.S. Pat. Nos. 3,059,673 and 4,257,162; or a telescoping full saw enclosure which collapses out of the way of the cutter bar, as shown in U.S. Pat. No. 2,638,944. Many of these prior art devices are cumbersome to use, can become clogged with sawdust and wood chips, and may seriously interfere with the operator's view of the cutter bar when the saw is in use or protect only one edge of the saw. For these and other reasons, most chainsaw safety guard devices remain unpopular with saw owners and manufacturers.

SUMMARY OF THE INVENTION

An object of the disclosed technology is to provide a chainsaw guard that covers the cutter bar and cutting chain of a chainsaw when the chainsaw is not in use, and allow exposure of the cutter bar and cutting chain when the guard contacts wood. Another object of the disclosed technology provides a chainsaw guard which can be readily attached to conventional chainsaws with simple hand tools. Yet another object of the disclosed technology is to provide a chainsaw guard that is relatively easy to install and does not prohibit or limit the cutting function. A further object of the disclosed technology is to provide a chainsaw guard that is easy to operate and maintain and adds little weight. Various other advantages of the disclosed technology may become apparent to those skilled in the art as a more detailed description is set forth below.

The disclosed technology accomplishes these objects and overcomes the drawbacks of the prior art. Specifically, the disclosed technology provides a retractable chainsaw guard that extends over the cutter bar and cutting chain until the guard is in contact with wood; upon contact, the guard retracts to expose at least a portion of the cutter bar and cutting chain, and resumes the extended position when the contact is removed. Thereby, the guard allows passage of the saw chain through the wood being cut, and quickly returns to its protective position at the end of the cutting operation.

The disclosed technology generally regards a chainsaw guard mountable on a chainsaw having a motor powerhead housing, a drive motor contained in the housing, a saw chain guide bar mounted on the housing, and a saw cutter chain driven by the drive motor and carried on the saw chain guide bar, the chainsaw guard forming a physical barrier that limits access to the saw cutter chain when the chainsaw guard is mounted on the powerhead housing. The chainsaw guard includes (a) a bracket member mountable to a chainsaw motor powerhead housing, the bracket member having a receiving track extending along its length, and (b) a retractable member movably engaged with the bracket member and designed and configured to sheathe the saw chain guide bar and saw cutter chain of the chainsaw when the chainsaw guard is mounted on a chainsaw. The retractable member has proximal and distal ends and a top, a bottom, and an elongated side forming an open sheath, and is translatable between and among a retracted position and an extended position relative to the bracket member. One or more compressible springs are engaged with one or more guide rods, wherein a first end of each guide rod is slidably received and supported by the bracket member, and a second end of each guide rod is secured to the distal end of the retractable member. The springs having a spring force to position the retractable member relative to the bracket member in the extended position until a force greater than the spring force is applied to the distal end of the retractable member, translating the retractable member towards the retracted position relative to the bracket member. When the force is removed from the distal end of the retractable member, the retractable member by the spring force moves to the extended position relative to the bracket member.

DESCRIPTION OF THE DRAWINGS

The nature and characteristic features of the disclosed technology will be more readily understood from the following description taken about the accompanying drawings.

DETAILED DESCRIPTION

Figure 17:
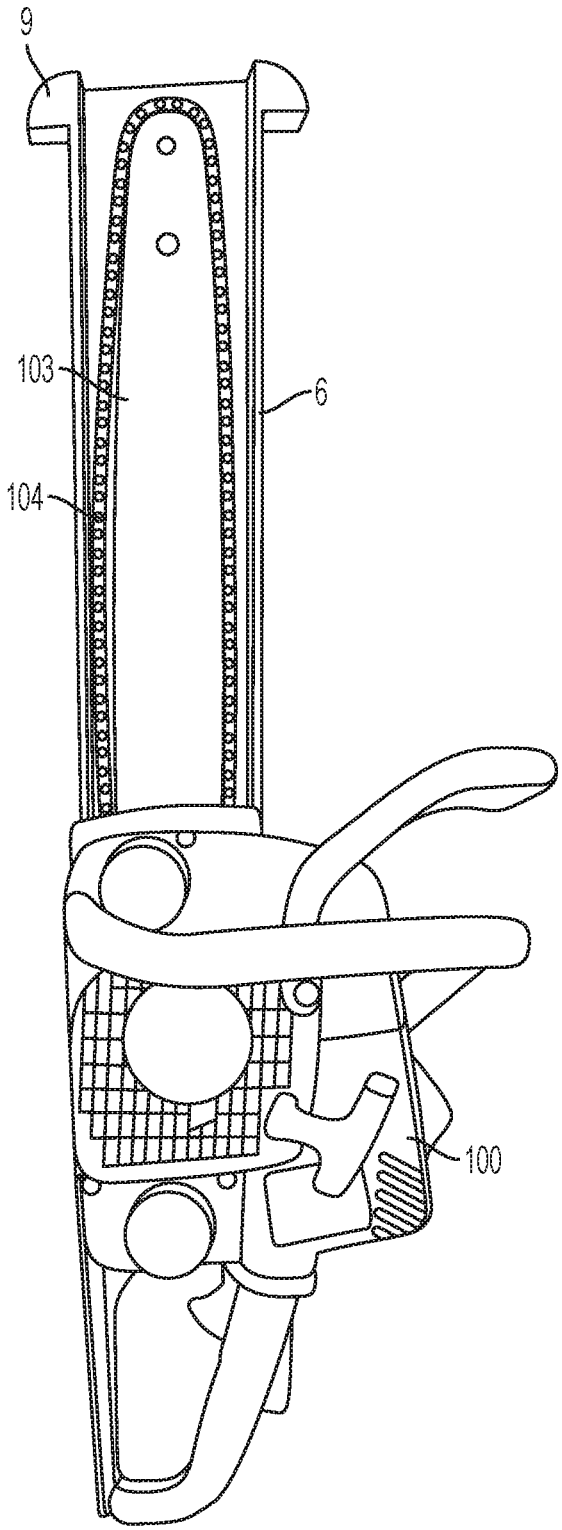
FIG. 17 is a side view of the chainsaw guard of the disclosed technology, affixed to a chainsaw.
Figure 18:
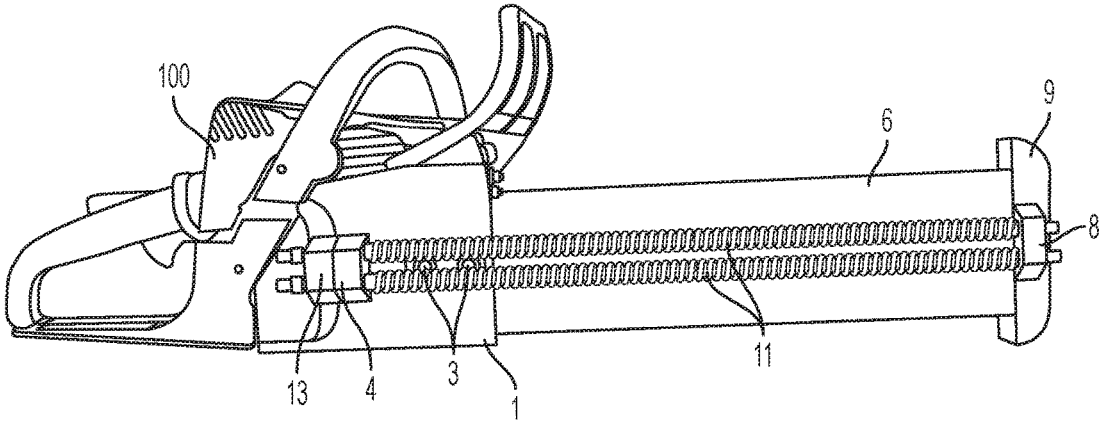
FIG. 18 is another side view of the chainsaw guard of the disclosed technology, affixed to a chainsaw.
Figure 19:
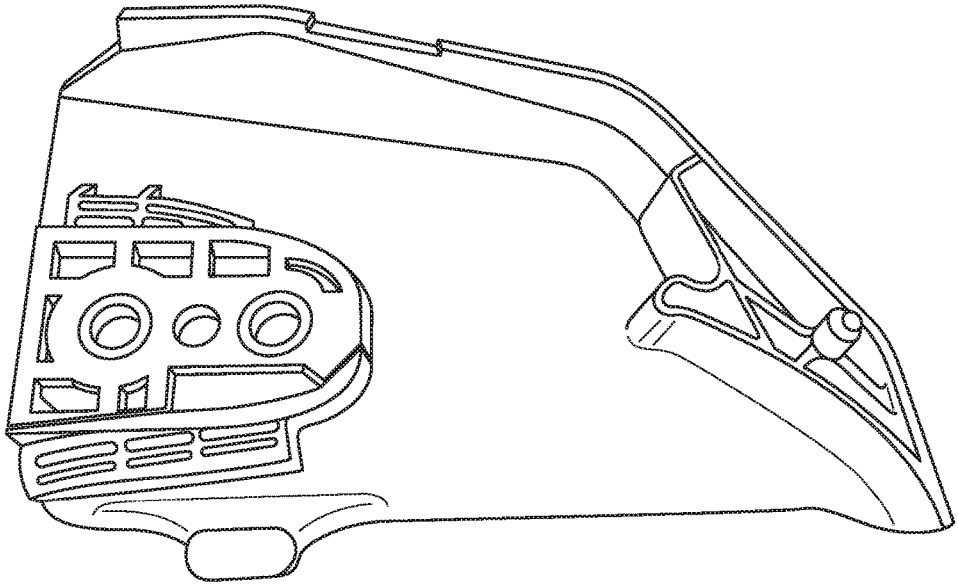
FIG. 19 PRIOR ART
FIG. 19 is an interior view of a chainsaw sprocket cover of a chainsaw.
Figure 20:
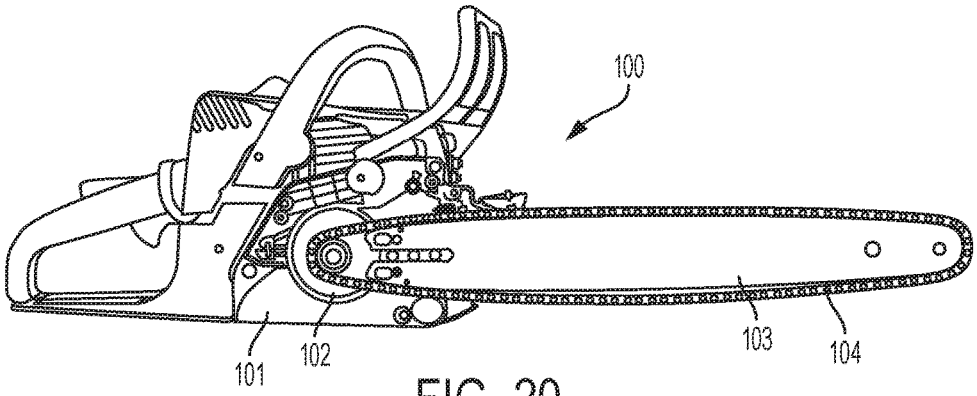
FIG. 20 PRIOR ART
FIG. 20 is a side view of a chainsaw, with the chainsaw sprocket cover removed.

Referring now more particularly to the drawings, embodiments of the chainsaw guard of the disclosed technology are illustrated in FIGS. 1-18. As shown in FIGS. 17-18, the chainsaw guard is intended for mounting on and use with a chainsaw 100 having a motor powerhead housing 101, a drive motor 102 contained in the housing, a saw chain guide bar 103 mounted on the motor powerhead housing, and a saw cutter chain 104 driven by the drive motor and carried on the saw chain guide bar. The saw cutter chain 104 is carried by the chain bar 103, which is detachably secured to the motor powerhead housing by two bolts and nuts with the bolts engaged in a slot in the saw chain guide bar. The chainsaw guard of the disclosed technology replaces the chain sprocket cover (shown in FIG. 19) which traditionally is secured to and covers the motor powerhead housing 101 by means of a plurality of bolts. When mounted on the chainsaw motor powerhead housing, the chainsaw guard of the disclosed technology forms a physical barrier that limits access to the saw cutter chain.

In the embodiment shown in FIGS. 1-16, the chainsaw guard includes a bracket member 1 mountable to a chainsaw motor powerhead housing, and a retractable member 6 slidably engaged with the bracket member and designed and configured to partially sheathe the saw chain guide bar 103 and saw cutter chain 104 of the chainsaw when the chainsaw guard is mounted on a chainsaw in its extended position (see FIGS. 17 and 18). In this manner, the retractable member 6 covers one side, the top and the bottom of the bar and chain, extending beyond the terminal end of the bar 103 and chain 104; no covering is provided over the other side of the bar and chain, and the terminal end of the chainsaw guard is open, allowing the retractable member 6 to slide relative to the bracket member 1, exposing or covering the bar and chain as it moves between the retracted (FIGS. 6 and 7) and extended (FIGS. 1, 17, 18) positions.

Figure 6:
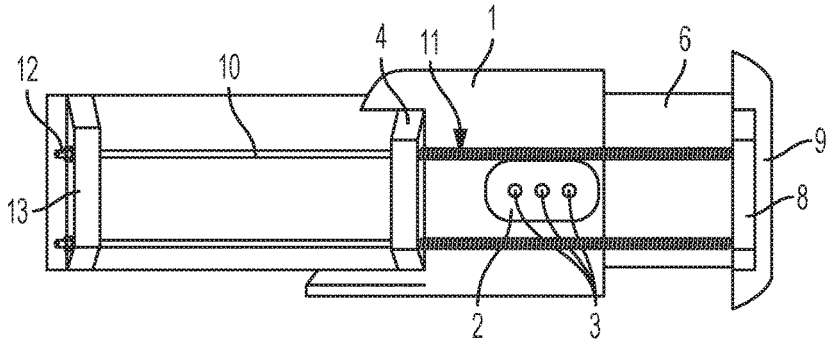
FIG. 6 is another exterior side view of the chainsaw guard of the embodiment of FIG. 1, wherein the guard is in a position between the extended and retracted positions.
Figure 7:
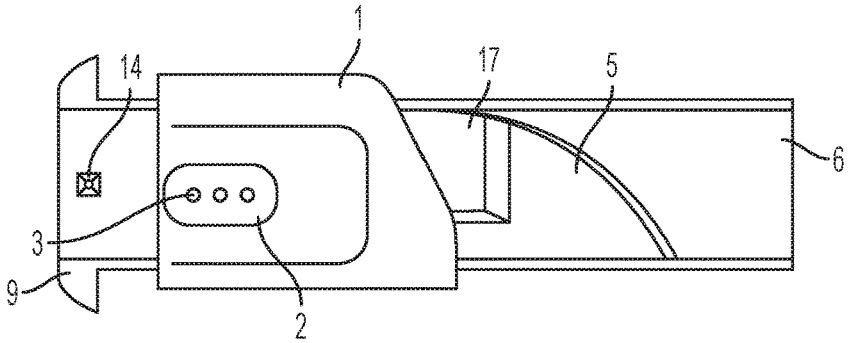
FIG. 7 is another interior side view of the chainsaw guard of the embodiment of FIG. 1, wherein the guard is in the fully retracted position.

The chainsaw guard of the disclosed technology further includes means 10, 11 to provide a restorative spring force for positioning the retractable member relative to the bracket member, between and among its retracted and extended positions, as well as positions there-between (shown in FIG. 6). In the retracted position (and positions between the retracted and extended positions), the saw cutter chain is exposed for cutting wood.

Figure 1:
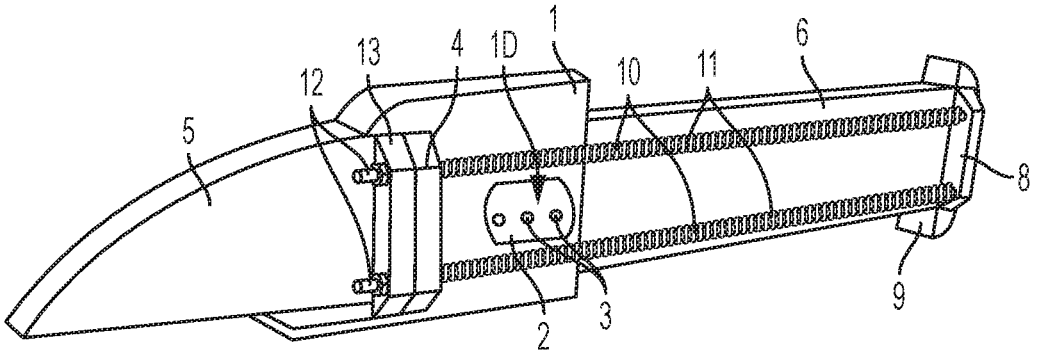
FIG. 1 is a perspective view of an embodiment of the chainsaw guard of the disclosed technology.
Figure 10:
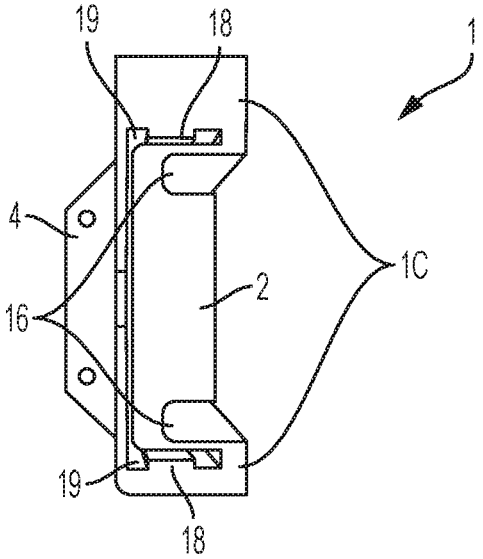
FIG. 10 is an anterior view of an embodiment of the bracket member of the disclosed technology.
Figure 11:
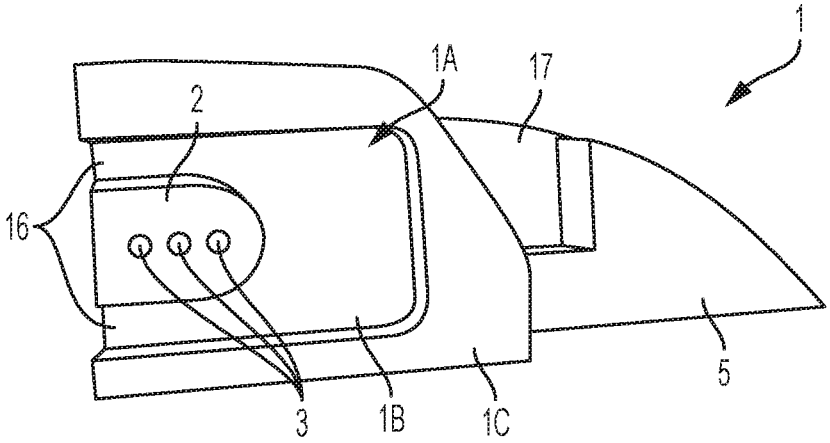
FIG. 11 is an interior view of the embodiment of the bracket member of FIG. 10.

In this embodiment, as shown in FIGS. 1, 10-11, the bracket member 1 comprises a vacuous area 1A formed within the interior surface area 1B of the bracket member 1, with a collar 1C forming the perimeter of the vacuous area, and a mounting bracket 2, the vacuous area being designed and configured to receive a portion of a specific chainsaw motor powerhead housing 101, and allow affixation of the chainsaw guard of the disclosed technology to the housing 101 as hereinafter described. Notably, chainsaw motor powerhead housings vary in configurations among manufacturers, and even among models; therefore, the design and configuration of the vacuous area 1A, the collar 1C, and the mounting bracket 2 (as hereinafter described), may be manufacturer and model specific.

The mounting bracket 2 of the bracket member 1 has one or more apertures 3 extending therethrough for receiving affixation bolts, screws or similar means to secure the bracket member to the motor powerhead housing of the chainsaw. As shown in FIGS. 1, 10, 11, the mounting bracket 2 is secured to the interior surface 1B of the bracket member, and seated in the vacuous area 1A thereof, extending from the surface 1B a sufficient distance so that when bolts are positioned through the mounting bracket and secured to the motor powerhead housing, the bolts do not interfere with the sliding engagement of the retractable member with the bracket member, as hereinafter described. The walls forming the mounting bracket should be sized and configured to sit within the aperture of the cutting blade, and allow the saw cutter chain to rotate about the mounting bracket at 16. The mounting bracket 2 is configured so that the surface of the mounting bracket abuts the motor powerhead housing when the bracket member is secured thereto; in most configurations (based upon manufacturer and model of chainsaw) this will require that the depth of the mounting bracket 2 extending from the interior surface 1B of the vacuous area 1A be less than the full depth of the vacuous area 1A. Further, when mounted on the motor powerhead housing the collar 1C of the bracket member (about the vacuous area) is designed and configured to abut the external walls or other structure of the motor powerhead housing. An aperture or port 1D through the bracket member 1 allows full access to the mounting bracket 2 from the exterior thereof, when the retractable member is in the extended position. The aperture or port 1D extends through and beyond the receiving track 19 (hereinafter described), without interfering with the slidable engagement of the retractable member 6 with the bracket member 1. By this access the bracket member may be easily removed or secured to the motor powerhead housing.

As hereinabove discussed, motor powerhead housings have varying surface shapes, aperture/bolt configurations and related structural designs for securing the chain sprocket cover to the saw, about the drive motor, saw chain guide bar and saw cutter chain. Therefore, the shape of the bracket member 1, vacuous area 1A, interior surface 1B, collar 1C, mounting bracket 2, port 1D and apertures 3 are designed and configured by model and manufacturer to secure the bracket to the motor powerhead housing in this same configuration. By replicating this chainsaw model/manufacturer specific configuration for affixation of the chain sprocket cover, the bracket member 1 may be affixed to, and abut securely against, the chainsaw housing and the motor powerhead housing by bolts (or other securing means).

Figure 5:
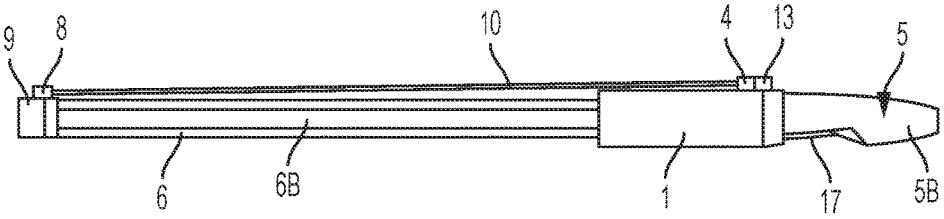
FIG. 5 is a top view of the chainsaw guard of the embodiment of FIG. 1.
Figure 8:
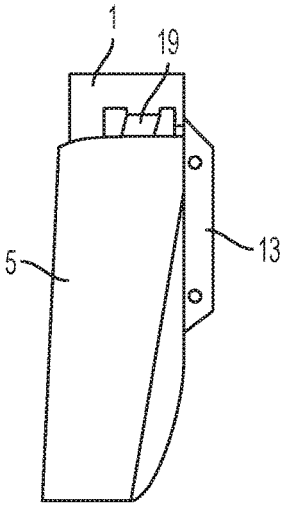
FIG. 8 is a posterior view of the chainsaw guard of the embodiment of FIG. 1.
Figure 9:
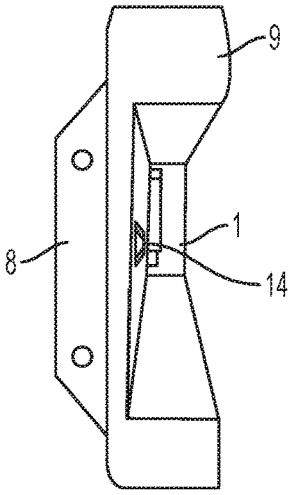
FIG. 9 is an anterior view of the chainsaw guard of the embodiment of FIG. 1.

The bracket member 1 further includes a receiving track 19 extending along its length to receive the retractable member 6 in sliding engagement with the bracket member. As shown in FIGS. 8 and 10, the receiving track 19 may be an interior channel of the member, sized and configured to receive and allow the retractable member to slide longitudinally within and through the member, while inhibiting material lateral movement of the retractable member. In the embodiment shown, the receiving track is a narrow, rectilinear channel extending within and through the length of the bracket at its top, bottom and side opposing the vacuous area 1A, to receive the top, bottom and side of the retractable member 6. To inhibit lateral or rotational movement of the retractable member and secure the retractable member in sliding engagement with the bracket member, a rail 18 may be provided in the top or bottom segments of the channel 19, or in both the top and bottom segments of the channel 19. In this configuration, the rail 18 may be sized and shaped to receive a corresponding groove 6B positioned along the length of the top and bottom of the retractable member 6 (as shown in FIG. 5). Alternative configurations for supporting and allowing sliding engagement of the retractable member relative to the bracket member between and among an extended position and a retracted position, and for inhibiting the lateral and rotational movement of the retractable member, may also be suitable.

The bracket member 1 further includes a first guide rod support structure 4 extending from the outer surface of the member, and having one or more apertures to receive and allow sliding engagement of one or more guide rods 10, as hereinafter described. Notably, the apertures of the first guide rod support structure 4 are sized to allow the guide rod(s) 10 to traverse the apertures, but maintaining the spring(s) 11 associated with each guide rod on one side of the aperture, thereby providing the restorative spring force for positioning the retractable member relative to the bracket member, between and among a retracted position and an extended position, as well as positions there-between.

Figure 2:
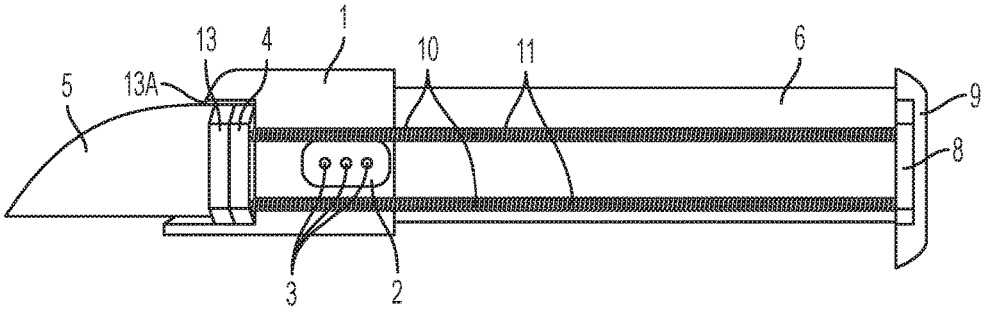
FIG. 2 is an exterior side view of the chainsaw guard of the embodiment of FIG. 1.
Figure 3:
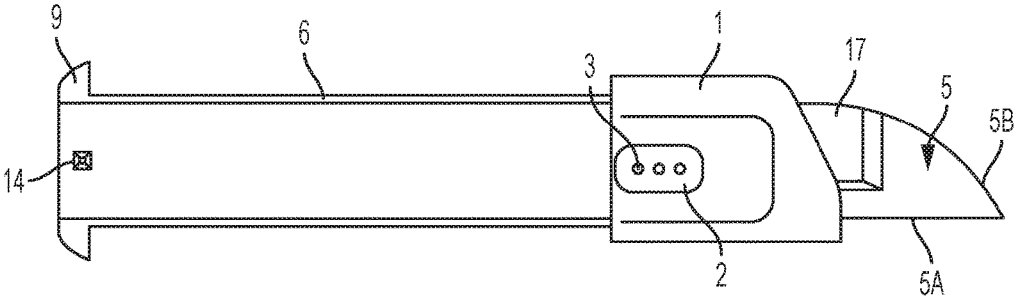
FIG. 3 is an interior side view of the chainsaw guard of the embodiment of FIG. 1.
Figure 4:
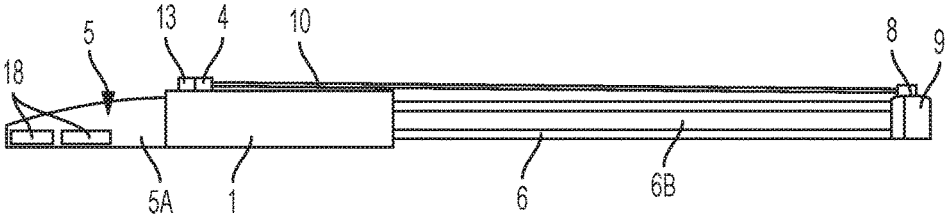
FIG. 4 is a bottom view of the chainsaw guard of the embodiment of FIG. 1.

As shown in FIGS. 1-5, 7, 8, 11 and 12, the bracket member 1 may further have a hollow woodchips exhaust 5 extending from an end thereof, facilitating and controlling expulsion of woodchips and other foreign materials from the chainsaw. The woodchips exhaust is sized, shaped and positioned on the bracket member so that the retractable member 6 slides over one side of the woodchips exhaust as it assumes its retracted position relative to the bracket member (see FIGS. 6 and 7). The wood chips exhaust comprises a bottom surface 5A, parallel with but positioned above the bottom surface of the bracket member, and is closed along an arced upper surface 5B. In some embodiments, as shown in FIG. 4, the bottom surface 5A has apertures 18 sized and configured to allow woodchips and other foreign material to exit the guard. In some configurations, a handle indention 17 may be provided in the wood chips exhaust structure (as shown in FIGS. 3, 11) to allow the retractable chainsaw guard to properly conform to the motor powerhead housing of said chainsaw.

The retractable member 6 of the chainsaw guard is slidably engaged with the bracket member by means of the bracket member's receiving track 19, such as the channel shown in FIGS. 8 and 10, and generally has proximal and distal ends, and side, top and bottom planate structures, sized and configured to be received within the bracket member's channel and allow the retractable member to slide longitudinally within and through the bracket member, while inhibiting material lateral movement of the retractable member. In this configuration, the retractable member partially sheathes (on three sides) the saw chain guide bar and saw cutter chain of the chainsaw when the chainsaw guard is mounted on a chainsaw and the retractable member is in the extended position. Furthermore, by these and similar configurations, the retractable member translates between and among a retracted position and an extended position relative to the bracket member.

In some embodiments (not shown) the retractable member includes a plurality of nested sections, which retract and extend; in other embodiments, the retractable member is a rigid member. The length of the top and bottom planate structures of the retractable member are designed to extend longitudinally beyond the saw chain guide bar and saw cutter chain when the retractable member is in its extended position. To spread the impact in the event of a kickback or cut-through, and thereby to minimize the impact injury on the operator, the width of the top and bottom structures of the retractable member cover and extend laterally beyond the saw chain guide bar and saw cutter chain.

In some embodiments, a groove 6B may be positioned along the length of the top and/or bottom surfaces of the retractable member 6, sized and shaped to receive one or more rails 18 of the channel 6A of the bracket member (see FIGS. 4, 5, 10 and 11). As hereinabove stated, alternative configurations for supporting and allowing sliding engagement of the retractable member 6 relative to the bracket member 1 between and among an extended position and a retracted position, and for inhibiting the lateral and rotational movement of the retractable member relative to the bracket member, may also be suitable.

At the distal end of the retractable member 6, bumpers 9 protrude from the bottom, top and side structures thereof, as shown in FIGS. 1-7, 9, and 13-18. The bumpers 9 may protrude a distance of between about 1-1½" from the top and bottom surfaces of the retractable member. By this configuration, the bumper provides a surface which may contact wood and facilitate generating the force greater than the spring force to move the retractable member 6 from the extended position towards or to the retracted position, as hereinafter described.

As shown in FIGS. 3, 7, 9 and 14, on the interior and near the distal end of the side of the retractable member 6 is a cutting bar bumper 14, positioned sufficiently far away from the distal end and centrally located so that when the retractable member is in the extended position, the bumper does not come in contact with the saw chain. When the chainsaw guard is mounted on the chainsaw, the cutting bar bumper 14 is intended to rest upon the cutter bar 103, thereby maintaining the interior side of the retractable member 6 a distance away from the saw cutter chain 104 (and the cutter bar 103) so that the cutter chain 104 does not come in contact with the retractable member 6.

Further, at or near the distal end of the retractable member, a second guide rod support structure 8 protrudes from the surface of the side of the retractable member (see FIGS. 1, 2, 4-6, 9, 13, 15, 16, 18). The second guide rod support structure 8 has one or more apertures aligned with the aperture(s) of the first guide rod support structure 4 when the retractable member 6 is slidably engaged with the bracket member 1, to receive and affix a second end of one or more guide rods 10, lateral with the outer surface of the retractable member. The guide rods 10 may be secured through the second guide rod support structure 8 by a nut or similar structure. In some embodiments, as shown in FIGS. 1, 2, 4-6, and 8, a third guide rod support structure 13 is provided at the proximal end of the retractable member, protruding from the surface of the side of the retractable member. The third guide rod support structure also has one or more apertures aligned with the aperture(s) of the first and second guide rod support structures when the retractable member is slidably engaged with the bracket member, to receive and affix (by means of a nut 12 or similar structure) a first end of one or more guide rods 10. In an alternate configuration, as shown in FIGS. 13-16 and 18, the guide rods 10 are unsecured at the first end of the guide rods, with a nut or similar structure provided on the first end to ensure that the rods do not pass through the apertures of the first guide rod support structure.

Further provided with the chainsaw guard of the disclosed technology is a compressible spring 11 to provide a spring force for positioning the retractable member between and among its retracted position and its extended position relative to the bracket member (see FIGS. 1, 2, 4, 6 and 18). In the embodiment shown, one or more guide rods 10 are slidably engaged within the apertures of the first guide rod support structure of the mounting bracket and affixed to the second guide rod support structure of the retractable member (and the third guide rod support structure of the retractable member, if any). The guide rods provide both rigidity to the guard, and stability for springs providing the spring force.

The compressible spring 11 is engaged about each of the guide rods, between the first and second guide rod support structures, the springs having a spring force when compressed to position the retractable member relative to the bracket member in the extended position until a force greater than the spring force is applied to the distal end of the retractable member (at the bumpers 9), translating the retractable member towards the retracted position relative to the bracket member; when the force is removed from the distal end of the retractable member, the retractable member by the spring force moves to the extended position relative to the bracket member. For example, a spring force of 7.3 psi is sufficient to restore the retractable member of an embodiment of the guard to its fully extended position in less than one-half second.

Figure 12:
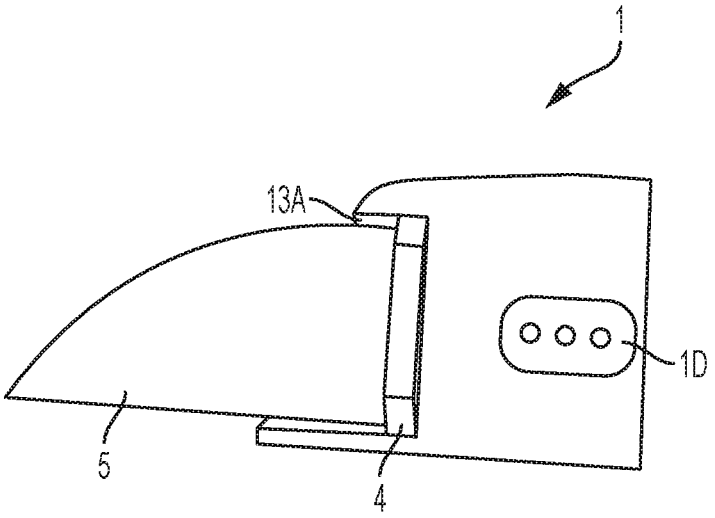
FIG. 12 is a posterior view of the embodiment of the bracket member of FIG. 10.
Figure 13:
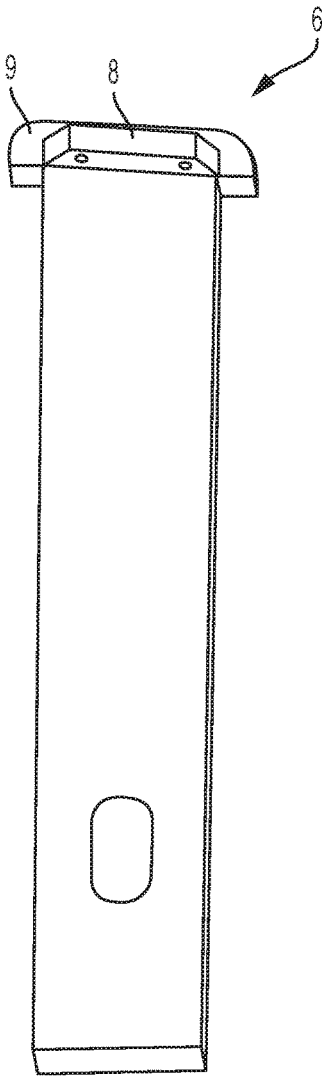
FIG. 13 is an exterior view of the embodiment of the retractable member of disclosed technology.
Figure 14:
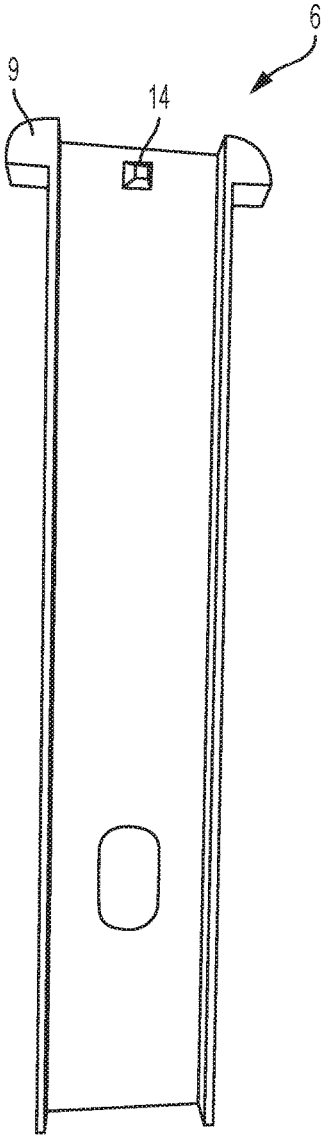
FIG. 14 is an exterior view of an embodiment of the retractable member of the disclosed technology.
Figure 15:
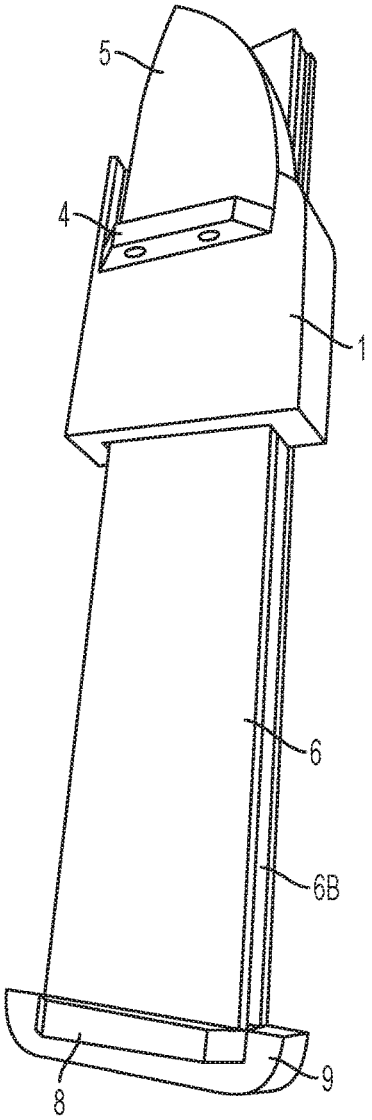
FIG. 15 is a perspective view of the embodiment of the bracket member of FIG. 10 and the retractable member of FIG. 14.
Figure 16:
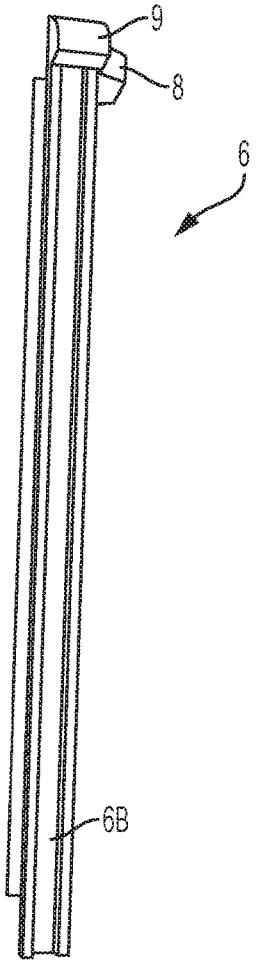
FIG. 16 is a top view of the embodiment of the retractable member of FIG. 14.

Furthermore, in some embodiments as shown in FIGS. 2, 6 and 12, a notch 13A is provided on the bracket member 1, at its distal end up to the first guide rod support structure, to receive the third guide rod support structure 13 mounted on the retractable member 6, as the retractable member traverses through the bracket member 1 to the extended position, as herein described.

The bracket member and retractable member may be plastic, metal, composites or combinations thereof, and the components of each member may be molded into a single unit, or affixed by any suitable and durable affixation means.

To install the chainsaw guard of the disclosed technology, a user removes the chain sprocket cover of the chainsaw; the bracket member of the chainsaw guard of the disclosed technology is then secured by means of one or more bolts (or similar securing structure) to the motor powerhead housing of the chainsaw such that (a) the mounting bracket sits flush with the chainsaw bar, and the apertures of the bar used to secure the chain sprocket cover align with the apertures 3 of the mounting bracket 2; and (b) the collar 1C sits flush with the chainsaw housing surface. The retractable members may be positioned within the receiving track 19 of the bracket member 1, before or after mounting the bracket member on the chainsaw housing. Likewise, the rods 10 and springs 11 may be secured to the bracket member and the retractable members before or after mounting the bracket member on the chainsaw housing.

In use, the chainsaw guard of the disclosed technology secured on a chainsaw as hereinabove described begins with the retractable member 6 in its extended position. When the user initiates a cut of wood, he applies a force on the bumper 9 greater than the spring force of the compression springs 11, and the retractable member of the guard moves towards its retracted position (based upon the force applied to the bumper by the user). When the user removes the saw from the wood, the applied force is removed and the springs cause the retractable member to return to its extended state.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

The invention claimed is:

1. A chainsaw guard mountable on a chainsaw having a motor powerhead housing, a drive motor contained in the housing, a saw chain guide bar mounted on the housing, and a saw cutter chain driven by the drive motor and carried on the saw chain guide bar, the chainsaw guard forming a physical barrier that limits access to the saw cutter chain when the chainsaw guard is mounted on the powerhead housing, the chainsaw guard comprising:

a bracket member mountable to the powerhead housing, the bracket member having a receiving track extending along its length, wherein the bracket member comprises a vacuous area formed within an interior surface of the bracket member, with a collar forming the perimeter of the vacuous area, and a mounting bracket positioned on the interior surface of the bracket member, in the vacuous area, the mounting bracket having one or more apertures for receiving affixation means to secure the bracket member to the motor powerhead housing of the chainsaw, and a retractable member movably engaged with the bracket member and designed and configured to sheathe the saw chain guide bar and the saw cutter chain of the chainsaw when the chainsaw guard is mounted on the chainsaw, the retractable member having proximal and distal ends and a top, a bottom, and an elongated side forming an open sheath, and being translatable between and among a retracted position and an extended position relative to the bracket member, and one or more compressible springs engaged with one or more guide rods, wherein a first end of each guide rod is slidably received and supported by the bracket member, and a second end of each guide rod is secured to the distal end of the retractable member, the springs having a spring force to position the retractable member relative to the bracket member in the extended position until a force greater than the spring force is applied to the distal end of the retractable member, translating the retractable member towards the retracted position relative to the bracket member; when the force is removed from the distal end of the retractable member, the retractable member is moved by the spring force to the extended position relative to the bracket member.

2. The chainsaw guard of claim 1, wherein the mounting bracket extends from the interior surface of the bracket member a sufficient distance so that when affixation means are positioned through the mounting bracket and secured to the motor powerhead housing of the chainsaw, the affixation means do not interfere with the sliding engagement of the retractable member with the bracket member.

3. The chainsaw guard of claim 2, wherein the bracket member further comprises a port through the bracket member, aligned with and providing access to the mounting bracket when the retractable member is in the extended position.

4. A chainsaw guard mountable on a chainsaw having a motor powerhead housing, a drive motor contained in the housing, a saw chain guide bar mounted on the housing, and a saw cutter chain driven by the drive motor and carried on the saw chain guide bar, the chainsaw guard forming a physical barrier that limits access to the saw cutter chain when the chainsaw guard is mounted on the powerhead housing, the chainsaw guard comprising:

a bracket member mountable to the powerhead housing, the bracket member having a receiving track extending along its length, wherein the receiving track comprises an interior channel of the bracket member, sized and configured to receive and allow the retractable member to slide longitudinally within and through the bracket member, and a retractable member movably engaged with the bracket member and designed and configured to sheathe the saw chain guide bar and the saw cutter chain of the chainsaw when the chainsaw guard is mounted on the chainsaw, the retractable member having proximal and distal ends and a top, a bottom, and an elongated side forming an open sheath, and being translatable between and among a retracted position and an extended position relative to the bracket member, and one or more compressible springs engaged with one or more guide rods, wherein a first end of each guide rod is slidably received and supported by the bracket member, and a second end of each guide rod is secured to the distal end of the retractable member, the springs having a spring force to position the retractable member relative to the bracket member in the extended position until a force greater than the spring force is applied to the distal end of the retractable member, translating the retractable member towards the retracted position relative to the bracket member; when the force is removed from the distal end of the retractable member, the retractable member is moved by the spring force to the extended position relative to the bracket member.

5. The chainsaw guard of claim 4, wherein the receiving track is a narrow, rectilinear channel extending within and through the length of the bracket member at its top, bottom and side.

6. The chainsaw guard of claim 5, wherein the receiving track comprises a rail formed in top and bottom segments of the channel, wherein the rail is sized and shaped to receive a corresponding groove positioned along a length of the top and bottom of the retractable member.

7. The chainsaw guard of claim 4, wherein a length of the top and bottom of the retractable member are designed to extend longitudinally beyond the saw chain guide bar and the saw cutter chain when the retractable member is in its extended position, and a width of the top and bottom of the retractable member cover and extend laterally beyond the saw chain guide bar and the saw cutter chain.

8. The chainsaw guard of claim 4, wherein the retractable member comprises a bumper at its distal end, the bumper protruding from the bottom, top and side of the retractable member.

9. A chainsaw guard mountable on a chainsaw having a motor powerhead housing, a drive motor contained in the housing, a saw chain guide bar mounted on the housing, and a saw cutter chain driven by the drive motor and carried on the saw chain guide bar, the chainsaw guard forming a physical barrier that limits access to the saw cutter chain when the chainsaw guard is mounted on the powerhead housing, the chainsaw guard comprising:

a bracket member mountable to the powerhead housing, the bracket member having a receiving track extending along its length, wherein the bracket member further comprises a first guide rod support structure extending from an outer surface of the bracket member, and a retractable member movably engaged with the bracket member and designed and configured to sheathe the saw chain guide bar and the saw cutter chain of the chainsaw when the chainsaw guard is mounted on the chainsaw, the retractable member having proximal and distal ends and a top, a bottom, and an elongated side forming an open sheath, and being translatable between and among a retracted position and an extended position relative to the bracket member, the retractable member comprises a second guide rod support structure at the distal end of the retractable member, and a compressible springs engaged with a guide rod, wherein the first guide rod support structure of the bracket member further comprises an aperture to receive and allow sliding engagement of the guide rod, wherein the aperture of the first guide rod support structure is sized to allow the guide rod to traverse the aperture, but maintaining the spring engaged with the guide rod on one side of the aperture, and wherein the second guide rod support structure of the retractable member has an aperture aligned with the aperture of the first guide rod support structure when the retractable member is slidably engaged with the bracket member, to receive and affix a first end of the guide rod, and wherein a second end of the guide rod is slidably received and supported by the bracket member, and the first end of the guide rod is secured to the distal end of the retractable member, the spring having a spring force to position the retractable member relative to the bracket member in the extended position until a force greater than the spring force is applied to the distal end of the retractable member, translating the retractable member towards the retracted position relative to the bracket member; when the force is removed from the distal end of the retractable member, the retractable member is moved by the spring force to the extended position relative to the bracket member.

10. The chainsaw guard of claim 9, wherein the retractable member further comprises a third guide rod support structure at the proximal end of the retractable member, the third guide rod support structure having one or more apertures aligned with the apertures of the first and second guide rod support structures to receive and affix the first end of the guide rod.

11. A chainsaw guard mountable on a chainsaw having a motor powerhead housing, a drive motor contained in the housing, a saw chain guide bar mounted on the housing, and a saw cutter chain driven by the drive motor and carried on the saw chain guide bar, the chainsaw guard forming a physical barrier that limits access to the saw cutter chain when the chainsaw guard is mounted on the powerhead housing, the chainsaw guard comprising:

a bracket member mountable to the powerhead housing, the bracket member having a receiving track extending along its length, wherein the bracket member further comprises a woodchips exhaust extending from an end thereof, facilitating and controlling expulsion of woodchips and other foreign materials from the chainsaw, and a retractable member movably engaged with the bracket member and designed and configured to sheathe the saw chain guide bar and the saw cutter chain of the chainsaw when the chainsaw guard is mounted on the chainsaw, the retractable member having proximal and distal ends and a top, a bottom, and an elongated side forming an open sheath, and being translatable between and among a retracted position and an extended position relative to the bracket member, wherein the woodchips exhaust is sized, shaped and positioned on the bracket member so that the retractable member slides over a side of the woodchips exhaust as it assumes its retracted position relative to the bracket member, and one or more compressible springs engaged with one or more guide rods, wherein a first end of each guide rod is slidably received and supported by the bracket member, and a second end of each guide rod is secured to the distal end of the retractable member, the springs having a spring force to position the retractable member relative to the bracket member in the extended position until a force greater than the spring force is applied to the distal end of the retractable member, translating the retractable member towards the retracted position relative to the bracket member; when the force is removed from the distal end of the retractable member, the retractable member is moved by the spring force to the extended position relative to the bracket member.

12. The chainsaw guard of claim 11, wherein the woodchips exhaust comprises a bottom surface, parallel with but positioned above a bottom surface of the bracket member, and is closed along an arced upper surface.

13. The chainsaw guard of claim 12, wherein the bottom surface of the woodchips exhaust comprises one or more apertures sized and configured to allow woodchips and other foreign material to exit through the apertures.

14. The chainsaw guard of claim 11, wherein the woodchips exhaust comprises a handle indention.

15. A chainsaw guard mountable on a chainsaw having a motor powerhead housing, a drive motor contained in the housing, a saw chain guide bar mounted on the housing, and a saw cutter chain driven by the drive motor and carried on the saw chain guide bar, the chainsaw guard forming a physical barrier that limits access to the saw cutter chain when the chainsaw guard is mounted on the powerhead housing, the chainsaw guard comprising:

a bracket member mountable to the powerhead housing, the bracket member having a receiving track extending along its length, and a retractable member movably engaged with the bracket member and designed and configured to sheathe the saw chain guide bar and the saw cutter chain of the chainsaw when the chainsaw guard is mounted on the chainsaw, the retractable member having proximal and distal ends and a top, a bottom, and an elongated side forming an open sheath, and being translatable between and among a retracted position and an extended position relative to the bracket member, wherein the retractable member further comprises a cutting bar bumper, positioned on an interior and near the distal end of the side of the retractable member, centrally located so that when the retractable member is in the extended position, the bumper does not come in contact with the saw chain, and one or more compressible springs engaged with one or more guide rods, wherein a first end of each guide rod is slidably received and supported by the bracket member, and a second end of each guide rod is secured to the distal end of the retractable member, the springs having a spring force to position the retractable member relative to the bracket member in the extended position until a force greater than the spring force is applied to the distal end of the retractable member, translating the retractable member towards the retracted position relative to the bracket member; when the force is removed from the distal end of the retractable member, the retractable member is moved by the spring force to the extended position relative to the bracket member.

* * * * *